United States Patent [19]

Smith

[11] 4,061,249

[45] Dec. 6, 1977

[54] AEROSOL DISPENSER RING

[76] Inventor: Dale Maxwell Smith, 99 Copeland Road, NE., No. D-16, Atlanta, Ga. 30342

[21] Appl. No.: 652,215

[22] Filed: Jan. 26, 1976

[51] Int. Cl.[2] ..... B65D 83/14; E05G 1/12

[52] U.S. Cl. ..... 222/78; 109/32; 222/402.15

[58] Field of Search ..... 222/78, 3, 402.15, 402.24; 42/1 G, 1 J; D22/99; 109/29, 32

[56] References Cited

U.S. PATENT DOCUMENTS

| | | | |
|---|---|---|---|
| 594,595 | 11/1897 | Brethauer | 222/78 |
| 3,353,749 | 11/1967 | LaHaug | 222/78 X |
| 3,830,404 | 8/1974 | Frazer | 222/78 |

*Primary Examiner*—Robert B. Reeves

*Assistant Examiner*—John P. Shannon

*Attorney, Agent, or Firm*—B. J. Powell

[57] ABSTRACT

A gas and/or aerosol dispenser ring for irritant substances to be worn on the hand of the user comprising a ring band to fit on the finger of the user's hand, a mounting on the ring band, and a dispenser assembly carried by the mounting with the dispenser assembly including a gas and/or aerosol reservoir containing a supply of gas or aerosol therein under pressure, a discharge valve assembly communicating with the supply of gas or aerosol in the reservoir to selectively discharge the gas or aerosol when the valve assembly is activated, a manually engageable trigger for selectively activating the valve assembly, and a false stone member substantially covering the reservoir and the discharge valve assembly to camouflage same.

5 Claims, 5 Drawing Figures

FIG 1
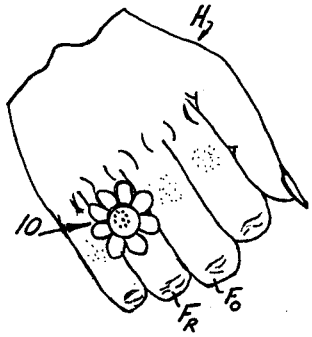
FIG 2
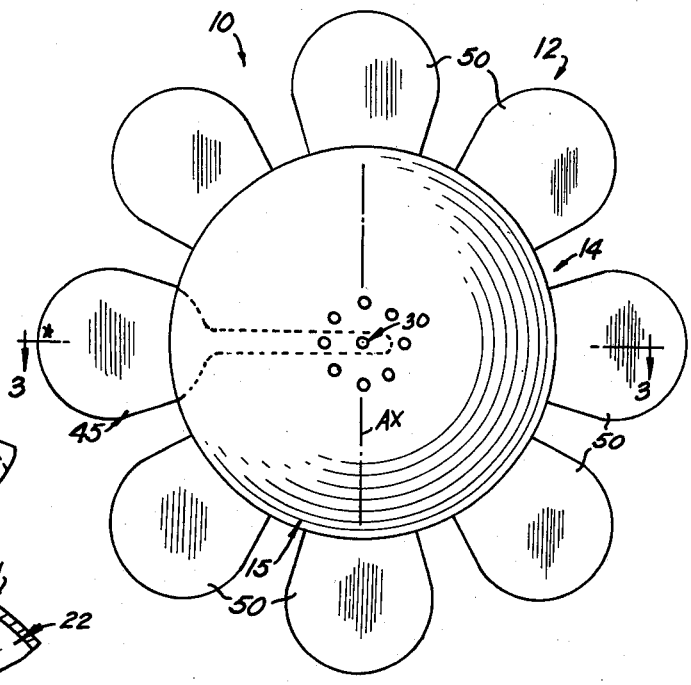
FIG 5
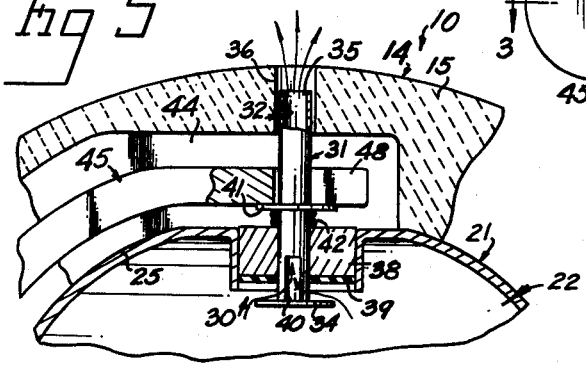
FIG 3
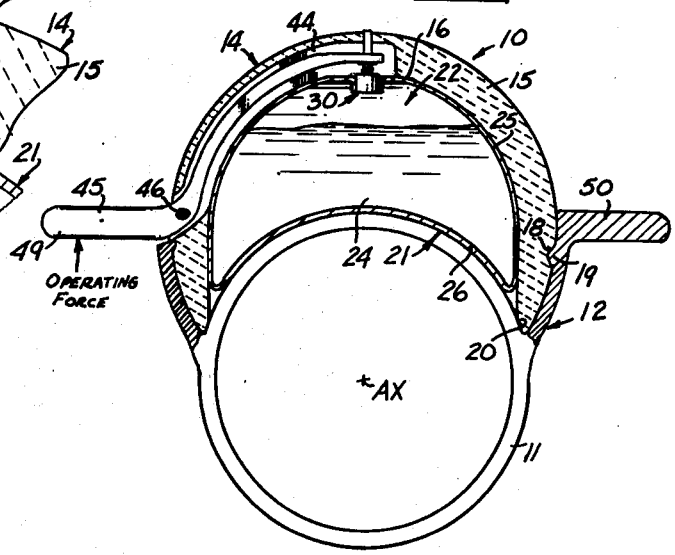
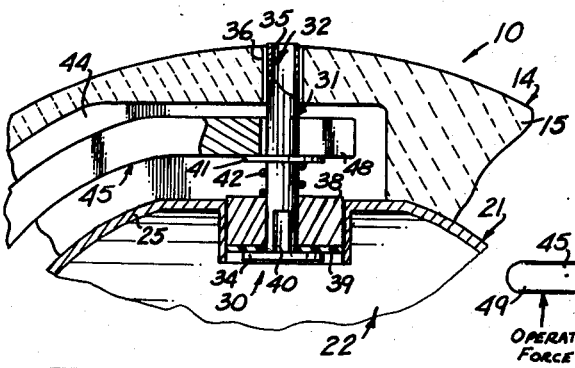
FIG 4

AEROSOL DISPENSER RING

BACKGROUND OF THE INVENTION

As the incidence of crime against the person has increased, a need has arisen for personal protection devices. One of the more widely accepted protection techniques is the use of an irritant gas which is sprayed on or toward the assailant to deter any attack. Numerous irritant gas dispensers have been proposed and marketed for this use. One of the primary problems with such prior art irritant gas dispensers is that the dispenser is usually carried in the person's pocket or purse thereby necessitating the victim having to find the dispenser in his pocket or purse and then orient such dispenser to properly discharge the irritant gas onto the assailant. In many instances, the time required to locate and use these proir art dispensers is sufficient for the assailant to have started his attack and the attack may have progressed to such a point that the victim is unable to use the dispenser.

SUMMARY OF THE INVENTION

These and other problems and disadvantages associated with the prior art irritant gas dispensers are overcome by the invention disclosed herein in that the dispenser is always readily available, the orientation of the dispenser to properly discharge the irritant gas is always known and the dispenser is extremely easy to operate. Thus, the time required to locate and orient such prior art dispensers is eliminated thereby greatly reducing the likelihood of the assailant starting the attack prior to the time that the dispenser can be used. The dispenser is in the form of a ring which is worn on a person's hand. The dispenser is camouflaged so that the dispenser appears to be a conventional ring normally worn by a person. Because the ring dispenser is located on the hand, the direction in which the irritant gas or aerosol is sprayed from the dispenser is always known thereby virtually eliminates the time needed to orient the dispenser since the user simply points his hand. Further, because the ring dispenser is always worn on the hand, it is always readily available for use.

The ring dispenser includes a ring band which is worn on the finger and which mounts a dispenser assembly thereon in the form of a false stone or other decorative feature. The operating trigger of the dispenser is incorporated into the decoration on the ring itself so that the user will know where the trigger is located to provide easy access thereto. The dispenser includes a reservoir which carries the irritant gas or aerosol in a compressed state and has a discharge valve thereon activated by the trigger to allow the irritant gas or aerosol to be propelled from the reservoir.

These and other features and advantages of the invention will become more clearly understood upon consideration of the following specification and accompanying drawings, wherein like characters of reference designate corresponding parts throughout the several views and in which:

BRIEF DESCRIPTION OF THE DRAWINGS

FIG. 1 is a perspective view of the invention being worn on the user's hand;

FIG. 2 is a top plan view of the invention;

FIG. 3 is a transverse cross-sectional view taken along line 3—3 in FIG. 2;

FIG. 4 is an enlarged cross-sectional viw of the dispensing valve in its closed positioned; and FIG. 5 is an enlarged cross-sectional view of the dispensing valve in its discharge position.

These figures and the following detailed description disclose specific embodiments of the invention, however, the inventive concept is not limited thereto since it may be incorporated in other forms.

DETAILED DESCRIPTION OF ILLUSTRATIVE EMBODIMENTS

Referring to the figures, it will be seen that the ring dispenser 10 is in the form of a decorative ring which includes a ring band 11 having a mounting 12 thereon to receive a dispensing assembly 14 therein. The dispensing assembly 14 includes a decorative false stone 15 generally semi-circular in shape and defining a reservoir receiving chamber 16 therein. The stone 15 may be attached to the mounting 12 in a number of ways, a notches 18 being illustrated in the stone 15 which is engaged by detents 19 on the mountin 12 to lock the stone position. The bottom of the stone 15 has a cylindrical cutout 20 therethrough so that the stone fits over the ring band 11 within the mounting 12. A generally semi-circular compressed gas or aerosol reservoir 21 is slidably received in the chamber 16 in the stone 15 and defines a reservoir chamber 22 therein for receiving the compressed irritant gas 24. It will be noted that the outer wall 25 of the reservoir 21 is shaped to fit within the chamber 16 while the inner wall 26 of reservoir 21 is shaped to fit over the ring band 11.

A discharge valve assembly 30 is provided through the outer wall 25 of the reservoir 21 which communicates with the reservoir chamber 22 so that the irritant gas or aerosol 24 can be dispensed therethrough. The discharge valve assembly 30 as best seen in FIGS. 4 and 5 includes a discharge tube 31 defining a passage 32 therethrough which is closed at its inner end by a valve disc 34 and has a discharge opening 35 at its outer end. It will be seen that an opening 36 is provided through the stone 15 so that the tube 31 projects thereinto for discharging the irritant gas therethrough. The discharge valve assembly 30 further includes a valve support block 38 which is fixedly mounted in the outer wall 25 of the reservoir 21 and slidably receives the inner end of the tube 31 therethrough. A sealing gasket 39 is provided about the discharge tube 31 at its inner end between block 38 and the valve disc 34 so that when the tube 21 is forced outwardly, the valve disc 34 engages the gasket 39 to prevent the discharge of irritant gas through the tube 32 as seen in FIG. 4. Inlet ports 40 are provided at the inner end of the tube 31 immediately outboard of the valve disc 34 so that when the valve tube 31 is forced into the reservoir chamber 22, the inlet ports 40 project through the gasket 39 as seen in FIG. 5 to allow the irritant gas 24 to be propelled through the discharge opening 35 of the passage 32. A drive collar 41 is provided about the tube 31 intermediate its ends and the tube 31 is constantly urged away from the reservoir chamber 22 by a coil spring 42 positioned between the collar 41 and the support block 38.

The stone 15 further defines a trigger recess 44 therein which extends from the vicinity of the valve assembly 30 out through one side of the stone 15 adjacent the mounting 12. A trigger 45 is pivotly mounted in the recess 44 on a pivot shaft 46. The inner end of the trigger 45 is slotted as indicated at 48 to fit around the discharge tube 31 outboard of the collar 41. The outer end of the trigger 45 is provided with an operating element 49 so that when the operating element is forced upwardly as seen in FIG. 3, the inner end of the trigger 49 will depress the collar 41 and the tube 31 therewith so that the tube 31 can be forced toward the reservoir chamber 22 to extend the ports 40 into the reservoir chamber 22 as seen in FIG. 5 and allow the compressed irritant gas or aerosol 24 in the chamber 22 to escape through the discharge opening 35 in tube 31. When the trigger 45 is released, however, the spring 42 will urge the tube 31 outwardly so that the valve disc 34 engages the gasket 39 and stops the flow of irritant gas or aerosol through the tube 31 an seen in FIG. 4.

It will be noted that the operating element 49 of the trigger 45 is in the form of a decorative petal and that the mounting 12 is provided with a plurality of decorative petal-shaped members 50 which are aligned with the plane of operating member 49. The petals 50 are spaced about the stone 15 so that the operating member 49 appears to be one of the petals 50 as seen in FIG. 2. To assist the user in identifying the petal-shaped operating element 49 indicia 51 is provided on the element 49 and is illustrated in the from of a small star in FIG. 2. It will further be noted that the distance $D_p$ between those petal-shaped member 50 adjacent the operating element 49 is such that these members 50 will assist in preventing an invertent activation of the trigger 45 to discharge the irritant gas or aerosol from ring dispenser 10.

The trigger 45 is oriented generally normal to the axis AX of the ring band 11 so that trigger 45 projects outwardly over the finger $F_o$ on the user's hand H adjacent the finger $F_R$ on which the ring dispenser 10 is worn. The user consciously raises the operating element 49 on trigger 45 to expel the irritant gas 24 while pointing his finger toward the assailant. Camouflaging dots 52 may be provided on stone 15 about the passage 36 therethrough to camouflage the discharge opening 35 in valve assembly 30.

As used herein aerosol shall be interpreted to include both a gas and a true aerosol since the gas is normally at least partly in a liquid state in the reservoir 21 and may be dispensed as fully gasified or part gas with liquid droplets therein. Further, it will be understood that other materials such as perfumes or deodorants may be dispensed by dispenser 10. The irritant may be one or more of a number of different irritant substances such as tear gas, chlorine, mace, ammonia, etc.

I claim:

1. A dispenser ring for dispensing aerosol adapted to be worn on the hand of the user comprising:

a ring band adapted to fit on the finger of the user's hand;

a mounting on said ring band;

a dispenser assembly carried by said mounting, said dispenser including an aerosol reservoir, a supply of aerosol carried in said aerosol reservoir under pressure; a discharge valve assembly communicating with said supply of aerosol in said reservoir to selectively discharge the aerosol when said valve assembly is activated, a false stone member substantially covering said aerosol reservoir and said discharge valve assembly to camouflage same; and trigger means for selectively activating said valve assembly; said trigger means pivotally mounted adjacent said reservoir and including an operating element projecting out from said false stone to be manually engaged by the user to activate said valve assembly.

2. The dispenser of claim 1 wherein said false stone defines a trigger recess therein opening out one side of said false stone, and wherein said dispenser assembly further includes a pivot shaft pivotally mounting said trigger means in said trigger recess so that said operating elements projects out of said false stone.

3. The dispenser of claim 2 wherein said operating element of said trigger means has a decorative configuration and wherein said mounting further includes a plurality of decorative members having a decorative configuration similar to said operating element circumferentially spaced about said false stone to camouflage said operating element.

4. The dispenser of claim 1 wherein said aerosol contains an irritant substance.

5. A dispenser ring for dispensing aerosol adapted to be worn on the hand of the user comprising:

a ring band adapted to fit on the finger of the user's hand;

a mounting on said ring band;

a dispenser assembly carried by said mounting, said dispenser assembly including an aerosol reservoir, a supply of aerosol carried in said aerosol reservoir under pressure; a discharge valve assembly communicating with said supply of aerosol in said reservoir to selectively discharge the aerosol when said valve assembly is activated, a camouflaging member substantially covering said aerosol reservoir and said discharge valve assembly to camouflage same; and trigger means for selectively activating said valve assembly; said trigger means pivotally mounted adjacent said reservoir and including an operating element projecting out from said camouflaging member to be manually engaged by the user to activate said valve assembly.

* * * * *